US008280088B2

(12) United States Patent
Kornagel

(10) Patent No.: US 8,280,088 B2
(45) Date of Patent: Oct. 2, 2012

(54) HEARING APPARATUS WITH FEEDBACK DETECTION AND CORRESPONDING METHOD

(75) Inventor: Ulrich Kornagel, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1266 days.

(21) Appl. No.: 11/804,290

(22) Filed: May 17, 2007

(65) Prior Publication Data

US 2007/0269069 A1 Nov. 22, 2007

Related U.S. Application Data

(60) Provisional application No. 60/801,666, filed on May 19, 2006.

(51) Int. Cl.
*H04R 25/00* (2006.01)

(52) U.S. Cl. ..... 381/318; 381/23.1; 381/72; 381/316; 381/317

(58) Field of Classification Search ..... 381/23.1, 381/302, 304, 305, 60, 312, 313, 316, 317, 381/318, 320, 331, 72, 204, 205, 123
See application file for complete search history.

(56) References Cited

U.S. PATENT DOCUMENTS

| | | | | |
|---|---|---|---|---|
| 6,404,895 | B1 | 6/2002 | Weidner | |
| 2002/0122562 | A1 * | 9/2002 | Brennan et al. | 381/316 |
| 2003/0026442 | A1 * | 2/2003 | Fang et al. | 381/318 |
| 2004/0109578 | A1 | 6/2004 | Niederdrank et al. | |
| 2004/0125966 | A1 * | 7/2004 | Weidner | 381/96 |
| 2005/0135646 | A1 * | 6/2005 | Arndt et al. | 381/318 |
| 2006/0093173 | A1 | 5/2006 | Hamacher et al. | |

FOREIGN PATENT DOCUMENTS

| | | | |
|---|---|---|---|
| DE | 199 04 538 | C1 | 7/2000 |
| EP | 1191814 | A1 | 3/2002 |
| EP | 1401242 | A2 | 3/2004 |
| EP | 1 648 197 | A1 | 4/2006 |

* cited by examiner

*Primary Examiner* — Vivian Chin
*Assistant Examiner* — Leshui Zhang

(57) ABSTRACT

To enable hearing apparatus feedback to be reliably detected, it is provided that the hearing apparatus has an analyzer for analyzing the resonant behavior of the overall system as a function of a modification of the signal processing device and for determining from the analysis result a feedback variable constituting a measure of the feedback. On the basis of the feedback variable, an adaptive compensation filter, for example, can then be step-size-controlled to compensate the feedback.

18 Claims, 1 Drawing Sheet

HEARING APPARATUS WITH FEEDBACK DETECTION AND CORRESPONDING METHOD

CROSS REFERENCE TO RELATED APPLICATIONS

The present application claims the benefit of the provisional patent application filed on May 19, 2006, and assigned application No. 60/801,666. The application is incorporated by reference herein in its entirety.

FIELD OF THE INVENTION

The present invention relates to a hearing apparatus with feedback detection. The present invention additionally relates to a corresponding method for detecting feedback in a hearing apparatus. Such a hearing apparatus is in particular a hearing aid, but also a headset and the like.

BACKGROUND OF THE INVENTION

If coupling (e.g. acoustic, electromagnetic, electrical, magnetic, etc.) is present between the inputs and outputs in a signal processing system, there is a risk of feedback effects occurring. An example of such an arrangement is a hearing aid as schematized in FIG. 1. The hearing aid can be represented as a digital system 1 located in a particular environment. The input is constituted e.g. by a microphone 2. The picked-up signal is, among other things, amplified and fed out again via an earpiece 3. Acoustic coupling takes place via a physical feedback path 4 from the earpiece 3 back to the microphone 2. As a result of the feedback, feedback whistle occurs if both the amplitude and the phase condition is met. Audible artifacts occur even if the above conditions are only barely met.

To suppress the feedback effects a method is known whereby the physical feedback path 4 is digitally simulated by means of an adaptive filter 5 which is fed by the earpiece signal. The earpiece signal in turn originates from the hearing aid's internal signal processing unit 6 which picks up the microphone signal and amplifies it, among other things. After filtering in the adaptive compensation filter the earpiece signal is subtracted from the microphone signal in an adder 7.

Two paths are therefore present in the system, the physically existing feedback path 4 and the compensation path digitally simulated via the adaptive filter 5. As the resulting signals of both paths are subtracted from one another at the input of the hearing aid, the effect of the physical feedback path 4 is ideally eliminated.

An important component in the adaptive algorithm for compensating the feedback path is its step-size control. This governs the speed with which the adaptive compensation filter 5 adapts to the physical feedback path 4. As there is no compromise for a fixed step size, this must be adapted to the situation in which the system currently finds itself. In principle, a large step size must be striven for in order to achieve fast adaptation of the adaptive compensation filter 5 to the physical feedback path 4. However, the disadvantage of a large step size is that perceptible signal artifacts are produced.

If a feedback situation is well sub-critical, the step size should be extremely small. If a feedback situation occurs, however, the step size should become large. This ensures that the algorithm adapts the adaptive compensation filter 5 only when its characteristic differs significantly from the characteristic of the feedback path 4, i.e. when re-adaptation is necessary. For this purpose, a feedback detector is required.

Patent specification DE 199 04 538 C 1 discloses a method for feedback detection in a hearing aid whereby a frequency band is defined, a first signal level is determined in the frequency band, the signal is attenuated on a signal transmission path of the hearing aid and a second signal level of the attenuated signal is determined in the frequency band. Feedback can be detected on the basis of the first and second signal levels determined. However, if the input signal level varies it is difficult to quantify the feedback. Another disadvantage is that an audible effect on the forward signal path is to be expected and also that only slow detection of the feedback takes place, as the bands are ideally examined consecutively.

SUMMARY OF THE INVENTION

The object of the present invention is therefore to enable hearing apparatus feedback to be reliably detected.

This object is achieved according to the invention by a hearing apparatus comprising a signal input device, a signal output device, a modifiable signal processing device between the signal input device and the signal output device and a feedback path from the signal output device to the signal input device, said feedback path producing a corresponding resonant behavior of the hearing apparatus depending on the setting of the signal processing device, as well as an analyzer for analyzing the resonant behavior as a function of a modification of the signal processing device and for determining from the analysis result a feedback variable constituting a measure of the feedback.

There is additionally provided according to the invention a method for detecting feedback in a hearing apparatus whose signal processing setting together with the feedback induces a resonant behavior, whereby the signal processing of the hearing apparatus is modified, the resonant behavior is analyzed as a function of the modification of the signal processing, and a feedback variable constituting a measure of the feedback is determined from the analysis result.

As mentioned in the introduction, input signals, output signals and feedback signals can be acoustic, electromagnetic, electrical, magnetic, etc. in nature. In each case the feedback determines the system characteristic of the overall system, and the operating point as well as the natural resonance of the system will change as the result of a system change.

A parameter of the signal processing device can be modified automatically and continuously for feedback detection. No additional knowledge concerning the feedback situation is therefore required, as the measure of the feedback is continuously determined.

Alternatively the hearing apparatus can have a feedback estimating device which initiates modification of the signal processing device when the feedback exceeds a predetermined measure in respect of quantity and/or quality. In particular, the feedback estimating device can include an oscillation detector with which a resonant frequency of the system can be determined which is selectively analyzed by the analyzer. Prior to detailed feedback detection, the feedback situation is estimated by the oscillation detector on the basis of oscillations occurring. Modification of the signal processing, for which the risk of audibility is always present, is only performed for feedback that has already occurred.

For feedback detection in the signal processing device, phase modification, delay modification and/or amplitude modification is preferably performed for a signal to be processed. Such system modifications can be easily implemented.

Preferably the signal processing is switched between at least two states, or continuous cross-fading between the states takes place. The analysis of the resonant behavior, in particular of the resonant frequency, can then be easily synchronized with the relevant switching or cross-fading instant.

The inventive hearing apparatus can have a feedback compensation filter whose adaptation step size is a function of the feedback variable of the analyzer. This in turn reduces the audibility of the compensation.

BRIEF DESCRIPTION OF THE DRAWINGS

The present invention will now be explained in greater detail with reference to the accompanying drawings in which.

DETAILED DESCRIPTION OF THE INVENTION

Figure 1:
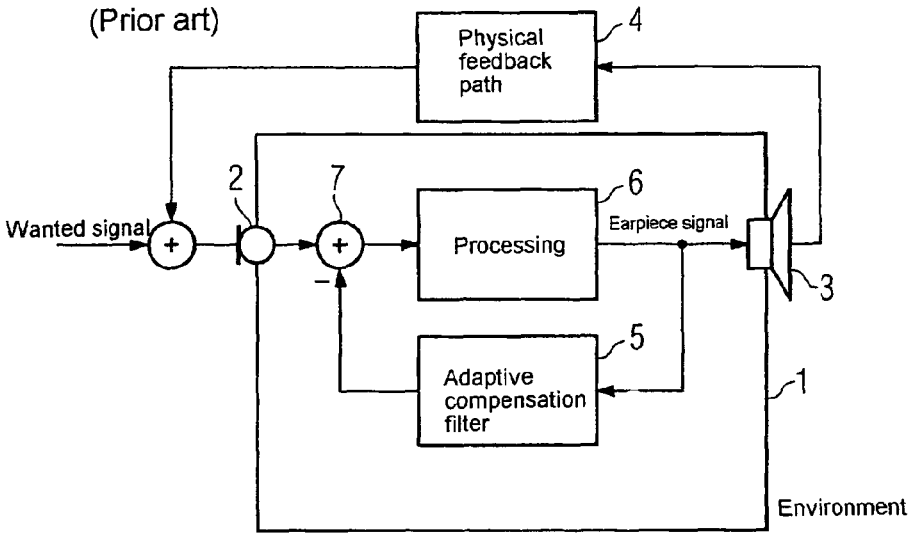
FIG 1 (Prior art)
FIG. 1 shows a signal processing system with feedback according to the prior art and FIG. 2 shows a simplified representation of a feedback detector according to the invention

The examples described below represent preferred embodiments of the present invention.

A system which is at or above the coupling limit because of the feedback path modifies the signal to be processed, or is unstable and oscillates.

In the case of a linear time-invariant system, systems theory predicts oscillations at one or more frequencies. These harmonics are not a priori different from oscillations which, looked at another way, are applied to a stable system as a wanted input signal. However, if the unstable system is modified in its characteristic in a defined manner, this is expressed in the change in the resonant behavior of the system and therefore in the change in the harmonic signal(s). Changes in a harmonic signal which correlate with the defined change in system behavior consequently indicate a feedback situation. A detector can monitor the signal behavior accordingly and respond in the event of feedback.

The basic requirement for feedback detection using system modification is that the system modification itself is inaudible.

According to a first simple embodiment, a continuously functioning modification unit is operated in the digital section of the overall system, the precise positioning being irrelevant. As soon as signals with corresponding modifications occur as the result of system modification, a feedback situation is present and is detectable e.g. from a change in the resonant frequency. Possible system modifications include:

- phase modification: the phase of a signal is modified according to a particular time profile, e.g. linear forward, linear backward rotated, linear forward and backward oscillating rotated, etc.
- delay modification (closely linked to phase modification)
- amplitude modification: e.g. the time envelope is sinusoidally modulated.

According to a more refined embodiment of the present invention, the system is only modified if it is already suspected that a feedback situation is present. A suspicion is e.g. justified if one or more harmonic signals are detected in the system by means of a traditional oscillation detector. In this case the system is inaudibly modified on a one-time basis. For example, the phase in the closed loop of the system is rotated once and in a defined manner to a new characteristic. This means that the system's resonance characteristic, in particular the natural resonant frequency, changes once and detectably. This causes the whistling of the hearing apparatus generally occurring in the event of resonance to change in pitch.

The advantage of non-continuous modification is that system modification need only take effect when feedback is suspected. The system otherwise behaves as prior to the introduction of a modification module, or rather any residual change is static, i.e. time-invariant, thereby enabling any interactions with other system components occurring in an overall arrangement to be prevented. In the case of a hearing aid this can mean that unwanted, time-variant interactions of the modulated signal components from the hearing aid with unmodulated signal components via a vent inflow can be prevented.

If the presence of a feedback situation is suspected, the system characteristics are inaudibly switched between two or more states or continuously cross-faded. The resulting reactions in respect of the characteristic of the harmonic signal indicate feedback whistle, i.e. a (supercritical) feedback situation. If the signal characteristic does not change, only wanted spectral components are present, i.e. a feedback situation is not present and consequently no feedback is detected.

The adaptation step size of the compensation filter is set on the basis of the detection result. If modification is detected, the step size is increased. This can take place for a certain, permanently specified time or for the time frame in which feedback is detected. Otherwise it assumes a low value.

The strength of the feedback can be inferred from the detected intensity of the system change (e.g. change in the resonant frequency). The step size controller can map this intensity to a step size according to a defining function.

Figure 2:
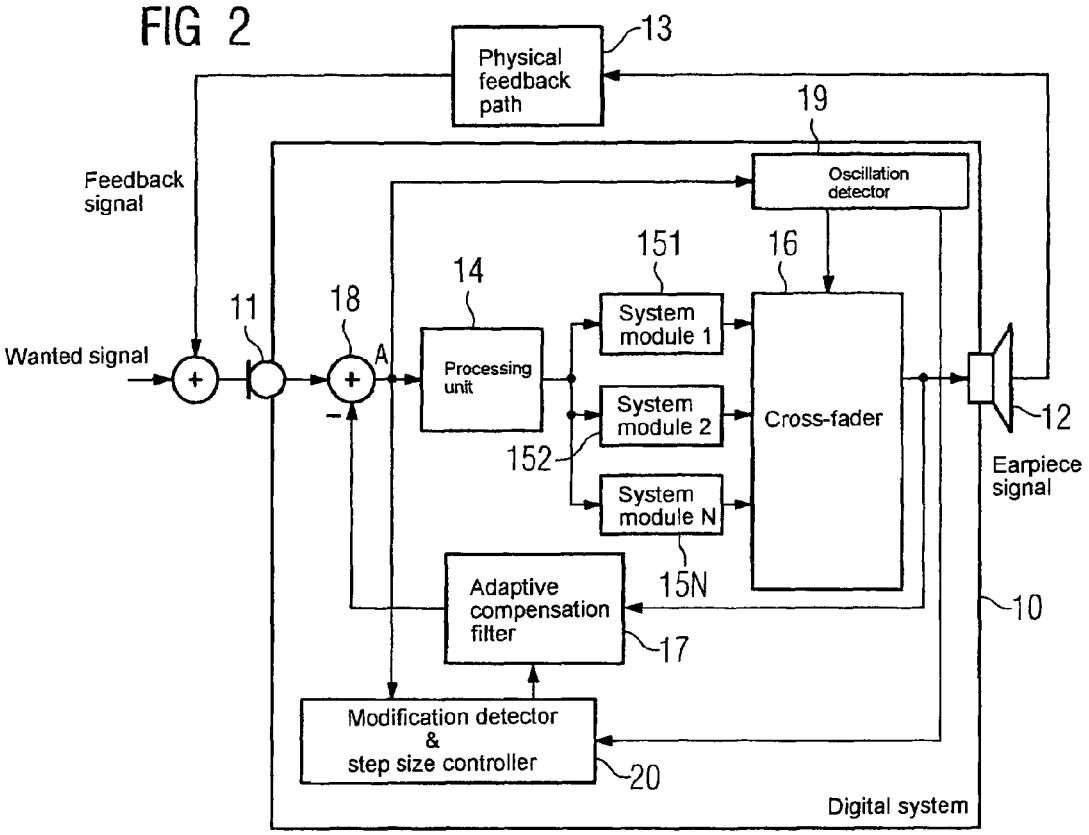

FIG. 2 shows a concrete example of a hearing apparatus according to the invention. The hearing apparatus can again be represented as a digital system 10. A microphone 11 of the digital system 10 picks up a wanted signal and a feedback signal from an earpiece 12 of the digital system 10. The feedback from the earpiece 12 to the microphone 11 takes place via the physical feedback path 13 in the environment of the digital system.

Within the digital system 10 the microphone output signal is fed to a processing unit 14. The output signal of the processing unit 14 undergoes further processing in a plurality of system modules 151, 152, 15N disposed in parallel, the output signals of which are in turn selected in a cross-fader 16 for forwarding to the earpiece 12 as an earpiece signal. In the event of a change from one system module output signal to the other, cross-fading can take place so that the two system module output signals are briefly provided in a varying ratio.

The earpiece signal is fed back via an adaptive compensation filter 17 to the microphone output signal and subtracted from same in an adder 18. The resulting difference signal is on the one hand fed to the processing unit 14 as an input signal and is also sampled at an analysis point A by an oscillation detector 19 which activates the cross-fader 16. The signal of the analysis point A is additionally sampled by a modification detector 20 which controls the adaptation step width of the compensation filter 17.

The system modules 151, 152, 15N describe different modules which can be optionally integrated into the system. Each system module represents a separate additional component or part of the signal processing of the overall system. For example, each system module can also be part of the processing unit 14.

Each module 151, 152, 15N defines per se a particular system characteristic. However, no audible change in system behavior will be produced when another module is incorporated into the signal processing, i.e. into the system.

When an oscillation is detected by the oscillation detector 19 cross-fading or switching from the currently incorporated system module to the next occurs. When the system module changes in frequency and/or amplitude and/or phase, if feedback whistle is present it will change in a manner consistent with the system change. This change in the resonant behavior will be detected by the modification detector 20 and initiate appropriate feedback compensation.

Alternatively, instead of using a plurality of system modules with fixed characteristics, a single system module with controllable characteristic can also be used. Cross-fading is then accomplished within this module e.g. by parameter variation.

The analysis point A need not necessarily be in the position shown in the example in FIG. 2. Rather each point within the digital system 10 can be used to measure a change in the resonant behavior of the overall system.

Specific time sequences of two detection situations will now be described, the system comprising N=2 modules with different phase characteristic. According to a first situation, a sinusoidal signal is present at the input, the system is stable and feedback whistle is not occurring. The system then reacts as follows:

1. The oscillation detector 19 responds.
2. Cross-fading from system module 1 to system module 2 takes place.
3. The modification detector 20 detects no frequency change in the oscillation.
4. Result: no feedback is detected.
5. Cross-fading back to system module 1 takes place. (Alternatively the system can also continue operating with system module 2. If the oscillation detector 19 initiates a new "request", i.e. feedback whistle is suspected, it is possible to switch back from system module 2 to system module 1. In the event of feedback whistle, this transition again results in a change in the oscillation frequency, or no change in the case of a regular input signal).

According to a second detection situation, no sinusoidal signal is present at the input, the system is unstable and feedback whistle is occurring. The system then reacts as follows:

1. The oscillation detector 19 responds.
2. Cross-fading from system module 1 to system module 2 takes place.
3. The modification detector 20 detects that the oscillation frequency is changing.
4. Result: the harmonic signal is the result of instability, therefore feedback is present.
5. As in the previous situation, the system can continue operating with system module 2 and only cross-fade if necessary, or it can fade back again immediately after feedback checking.

In order to also cover the eventuality that feedback whistle arises e.g. after a sine wave has been applied to the system as a wanted signal and this oscillation has already been detected as "non-feedback whistle", system module switching can be repeated within a certain time interval as long as the oscillation detector 19 responds.

In a further embodiment, the oscillation detector 19 only detects whether an oscillation is present, without knowing the frequency of the oscillation. In this case the modification detector 20 must undirectedly analyze the overall signal for signal changes after cross-fading from one system module to the next.

According to an alternative embodiment, the oscillation detector 19 also determines the oscillation frequency (frequencies) and transmits it/them to the modification detector 20 which can then specifically analyze this/these frequency/frequencies in the event of cross-fading from one system module to the next, which should ensure a more robust system behavior.

The invention claimed is:

1. A hearing apparatus, comprising a signal input device that receives an acoustic input signal and generates an output signal;

a signal processing device that processes the output signal from the device to produce an output signal;

a plurality of system modules coupled in parallel circuit to receive the output signal from the signal processing device;

a cross-fader coupled to receive and selectively provide cross-fading to respective output signals from the plurality of system modules to supply a cross-fader output signal, wherein the cross-fader is configured to selectively effect a change by way of cross-fading from an output signal from at least one of the plurality of system modules to an output signal from at least another of the plurality of system modules;

an oscillation signal analyzer that:

analyzes a resonant behavior of the hearing apparatus as a function of a modification of the signal processing device, wherein said modification causes a change in the cross-fader output signal, wherein the cross-fader is responsive to a control signal from the oscillation signal analyzer to effect said change, and measures an oscillation in a feedback signal; and a signal output device coupled to receive the cross-fader output signal, wherein the signal output device converts the cross-fader output signal to an acoustic output of the hearing apparatus, wherein the change from the output signal from said at least one of the plurality of system modules to the output signal from said at least another of the plurality of system modules is inaudibly in the acoustic output of the hearing apparatus due to the cross-fading provided by the cross-fader to the respective output signals from the plurality of system modules.

2. The hearing apparatus as claimed in claim 1, wherein the feedback signal is generated from the cross-fader output signal and fed back to the signal input device via a physically existing feedback path.

3. The hearing apparatus as claimed in claim 2, wherein the resonant behavior of the hearing apparatus is induced by the feedback path and based on a setting of the signal processing device.

4. The hearing apparatus as claimed in claim 1, wherein a parameter of the signal processing device is modified automatically and continuously.

5. The hearing apparatus as claimed in claim 1, wherein the oscillation signal analyzer is configured to initiate the modification of the signal processing device if the oscillation in the feedback signal exceeds a predetermined measure.

6. The hearing apparatus as claimed in claim 5, wherein the predetermined measure comprises a quantity measurement, a quality measurement or both.

7. The hearing apparatus as claimed in claim 5, wherein the oscillation signal analyzer comprises an oscillation detector configured to determine a resonant frequency of the hearing apparatus that is selectively analyzed by the analyzer.

8. The hearing apparatus as claimed in claim 1, wherein the modification of the signal processing device is selected from the group consisting of: phase modification, delay modification, and amplitude modification.

9. The hearing apparatus as claimed in claim 1, wherein the signal processing device is continuously cross-faded between at least two states.

10. The hearing apparatus as claimed in claim 1, furthering comprising an adaptive compensation filter whose adaptation step width is a function of the feedback signal.

11. A method for detecting a feedback signal in a hearing apparatus, comprising:

modifying a signal processing device of the hearing apparatus, wherein the modifying of the signal processing device comprises coupling a plurality of system modules in parallel circuit to receive an output signal from the signal processing device, and selectively cross-fading by way of a cross-fader respective output signals from the plurality of system modules to supply a cross-fader output signal, wherein the cross-fading is configured to selectively effect a change from an output signal from at least one of the plurality of system modules to an output signal from at least another of the plurality of system modules;

analyzing by way of an oscillation signal analyzer a resonant behavior of the hearing apparatus as a function of the modifying, which causes a change in the cross-fader output signal, wherein the cross-fading is performed in response to a control signal from the oscillation signal analyzer to effect said change;

determining a measurement of an oscillation in the feedback signal based on the analyzing;

coupling a signal output device to receive the cross-fader output signal; and converting the cross-fader output signal to an acoustic output of the hearing apparatus by way of the signal output device, wherein said change from the output signal from said at least one of the plurality of system modules to the output signal from said at least another of the plurality of system modules is inaudibly in the acoustic output of the hearing apparatus due to the cross-fading provided by the cross-fader to the respective output signals from the plurality of system modules.

12. The method as claimed in claim 11, wherein the resonant behavior is induced by a setting of the signal processing device together with the feedback signal.

13. The method as claimed in claim 11, wherein the signal processing device is modified if the measurement of the oscillation in the feedback signal exceeds a predetermined measure.

14. The method as claimed in claim 11, wherein a resonant frequency of the hearing apparatus is determined and selectively analyzed.

15. The method as claimed in claim 11, wherein the modification of the signal processing device is selected from the group consisting of: phase modification, delay modification, and amplitude modification.

16. The method as claimed in claim 11, wherein the signal processing device is modified by continuous cross-fading the signal processing device between at least two states.

17. The method as claimed in claim 11, wherein the feedback signal is compensated via an adaptive compensation filter whose adaptation step width is a function of the feedback signal.

18. A hearing apparatus, comprising a signal input device that receives an acoustic input signal and generates an output signal;

a signal processing device that processes the output signal from the device to produce an output signal;

a system module having a plurality of controllable characteristics, the system module coupled to receive the output signal from the signal processing device, wherein the system module is configured to selectively vary respective parameters of the controllable characteristics and supply an output signal;

an oscillation signal analyzer that:

analyzes a resonant behavior of the hearing apparatus as a function of a modification of the signal processing device, wherein said modification causes a change in the output signal from the system module, wherein the system module is responsive to a control signal from the analyzer to effect said change by way of a variation of the respective parameters of the controllable characteristics of the system module, the parameter variation configured to provide a cross-fading effect, and measures an oscillation in a feedback signal; and a signal output device coupled to receive the output signal from the system module, wherein the signal output device converts the output signal from the system module to an acoustic output of the hearing apparatus, wherein the modification of the signal processing device is inaudibly in the acoustic output of the hearing apparatus due to the cross-fading effect provided by the system module.

* * * * *